US006062506A

United States Patent [19]

Eck et al.

[11] Patent Number: 6,062,506

[45] Date of Patent: May 16, 2000

[54] PROCESS AND DEVICE FOR PRODUCING A PACKAGE OF ELONGATED WINDING MATERIAL

[75] Inventors: Werner Eck, Laupheim; Hans-Georg Hörndler, Barthelmesaurach, both of Germany

[73] Assignee: Maschinenfabrik Niehoff GmbH & Co. KG, Schwabach, Germany

[21] Appl. No.: 09/245,597

[22] Filed: Feb. 5, 1999

Related U.S. Application Data

[62] Continuation-in-part of application No. 08/970,962, Nov. 14, 1997, abandoned, which is a continuation of application No. 08/446,880, filed as application No. PCT/EP92/02804, Dec. 4, 1992, abandoned.

[51] Int. Cl.[7] ..... B65H 54/22; B65H 54/28; B65H 75/14

[52] U.S. Cl. ..... 242/473.5; 242/480.7; 242/483.3; 242/484.1; 242/605; 242/608.5

[58] Field of Search ..... 242/608.2, 605, 242/608.5, 609.1, 609, 613.5, 614.1, 118.6, 118.4, 608.3, 473.5, 480.7, 483.3, 484.1

[56] References Cited

U.S. PATENT DOCUMENTS

| | | | |
|---|---|---|---|
| 3,201,061 | 8/1965 | Volk | 242/118.6 X |
| 3,307,800 | 3/1967 | Macedo | 242/118.6 X |
| 3,753,342 | 8/1973 | Yoshitake et al. . | |
| 3,822,841 | 7/1974 | Campbell . | |
| 4,269,371 | 5/1981 | Kovaleski | 242/118.6 |
| 4,377,264 | 3/1983 | Kovaleski et al. . | |
| 4,483,490 | 11/1984 | Engmann et al. | 242/25 R |
| 4,738,406 | 4/1988 | Lothamer | 242/25 R X |
| 5,174,013 | 12/1992 | Hiroshima et al. | 242/25 R X |
| 5,255,863 | 10/1993 | Horndler | 242/25 R X |
| 5,593,108 | 1/1997 | Eck et al. | 242/608.5 |

FOREIGN PATENT DOCUMENTS

| | | |
|---|---|---|
| 0 334 211 B1 | 9/1989 | European Pat. Off. . |
| 0 504 503 A1 | 9/1992 | European Pat. Off. . |
| 2 100 765 | 1/1983 | United Kingdom . |

*Primary Examiner*—Michael R. Mansen
*Attorney, Agent, or Firm*—Pearne, Gordon, McCoy & Granger LLP

[57] ABSTRACT

A process and device are disclosed for producing a package of elongated winding material. A winding bobbin (50) has a conical winding core (52) and a first detachable flange (53) arranged at the side of the winding core (52) having the smaller diameter, and a second flange (54) arranged at the other side of the winding core (52). The winding bobbin (50) is held in a winding device by means of bobbin holding members (103, 104) which center both flanges (53, 54) and are supported on their surface opposite to the winding core (52). The elongated winding material (D) is then wound on the bobbin (50), the winding process being controlled in such a way that a predetermined type of bobbin is obtained. In particular when a plastic bobbin (50) is used, the package is easy to transport but is at the same time very resistant, so that additional packaging measures may be dispensed with. Packaging waste may thus be almost entirely avoided.

16 Claims, 15 Drawing Sheets

PROCESS AND DEVICE FOR PRODUCING A PACKAGE OF ELONGATED WINDING MATERIAL

This is a continuation-in-part of application Ser. No. 08/970,962, filed Nov. 14, 1997, now abandoned, which was a continuation of application Ser. No. 08/446,880, filed Aug. 22, 1995, now abandoned, which is a Section 371 of International Application No. PCT/EP92/02804, filed Dec. 4, 1992.

BACKGROUND OF THE INVENTION

The present invention relates to a process and a device for producing a package of elongated winding material. Here elongated winding material is preferably to be understood as winding material containing metal, in particular copper, such as wire, blank or plastic-coated strands and so on. However, the invention shall also be applicable to winding material such as glass fibre cables, windable in a similar way as the examples mentioned. For simplicity reasons such elongated winding material is referred to as wire in the following paragraphs.

DESCRIPTION OF RELATED ART

Wire, in particular copper wire, is normally transported as a package, consisting of a metal bobbin and the wire wound on it.

The metal bobbin is designed rotationally symmetrical and includes a cylindrical or conical winding core, one flange being arranged at either end. The winding devices comprise correspondingly conical bobbin holding members, engaging into the conical recesses of the bobbin, at the same time holding and centering them during the winding process. The winding itself is performed either by rotating the bobbin, or by putting the wire onto the stationary bobbin by means of a flyer device, revolving round the bobbin. In case of a rotating bobbin the wire is wound up twist-free, in case a flyer device is used, a turning of the wire, a so-called twist of 360° per winding, results.

Metal bobbins offer the advantage of high resistance and long life time. However, this is opposed by the disadvantage of a relatively high weight portion of the metal bobbin in the finished package and the metal bobbins have to be transported from the user back to the manufacturer, causing considerable additional transport costs.

Those skilled in the art therefore tried to find a process for producing packages doing without a bobbin. Such a process is described in EP-B-0 334 211.

In the process described there a winding tool consisting of metal is used, designed as a conventional metal bobbin, however the winding core being designed conically and the flange at the end of the winding core with the smaller diameter being detachable. A thin pasteboard tube is put onto this winding core and the wire is then wound on in layers of increasing number of turns, these numbers of turns being chosen such that it results in layers inclined towards the conical winding core. This is called a double-conical winding design or an opposed conical winding. After the winding process the lower flange of the winding tool is loosened and the winding tool is removed from the bobbin, after the bobbin-less package has been hooped and coated with plastic foil.

This package offers the advantage of a favourable transport volume and weight and a good strength with optimum wind-off conditions of the wire at the user. The packaging materials used need not be transported back to the wire manufacturer, thus no transport costs incur. Therefore this packaging of winding material has become generally accepted by many wire users.

However, this bobbin-free packaging has one disadvantage, being of less importance for small and medium-size users, however of major importance for large users, such as the automotive industry. The automotive industry needs large amounts of copper strands coated with insulating material, today in many cases manufactured and supplied in form of such bobbin-free packages. In accordance with today's manufacturing philosophy, the packages are supplied directly from the cable manufacturer to the consumer, creating a considerable amount of packaging waste, i.e. pasteboard tubes, fastening straps and plastic coatings which have to be collected and disposed.

In addition the handling of the bobbin-free packages presupposes a certain care during transport, as the pasteboard used is sensitive to humidity and the package may easily be damaged when stacked roughly.

Therefore it is the task of the present invention to create a process and a device for producing a package, having favourable transport properties on the one hand, however, doing with a small amount of packaging material on the other hand.

As provided for by this invention this task is solved by the invented process.

The process as provided for by this invention is set forth herein.

The process as provided for by this invention makes it possible to produce a package having favourable transport properties, creating almost no packaging waste.

This is achieved by using a divisable winding bobbin, preferably made of plastic. As the winding bobbin is designed as a divisible one, the winding bobbin may be disassembled after winding off the winding material. Thus the transport volume for transporting the empty bobbins from the wire users back to the wire manufacturers is considerably reduced.

The flanges of the winding bobbin will be supported from outside during the winding process. This offers the advantage that the flanges do not have to absorb axial winding pressure during the winding procedure and thus they may be manufactured with less material and this results in less weight. On the other hand this results in the major advantage that this design considerably reduces the occurrence of elastic restoring forces, in particular at the lower bobbin flange. In case a plastic bobbin is chucked with conventional conical chucking devices, the flanges deform during winding to the outside as seen from the winding core due to the axial winding pressure. This results in a restoring force of the flanges, pressing on the finished winding, possibly resulting in winding-off problems later on. However, if the flange deforming is prevented during winding, as proposed by the present invention, no elastic restoring force is created, there is no loading on the package and a hooping of the package is not necessary. Thus neither a pasteboard insert nor hooping material is required or has to be disposed of.

For large users of copper wire and/or copper strands with insulation, such as the automotive industry, the package provided for by the present invention results in major advantages.

The plastic bobbin preferably used has a low weight, however it is true that the overall weight of the package is higher than the weight of a comparable bobbin-free package, but it is considerably lower than the overall weight of a package using a conventional metal bobbin.

As the bobbins used may be divided, the bobbins may be divided immediately after emptying them and they may be stacked in a space-saving way. Therefore the automotive industry does not need additional storing room for the empty bobbins or other packaging containers (e.g. casks).

The empty bobbins may be transported back to the cable manufacturer as soon as a new delivery of filled plastic bobbins arrives. Due to the low loading volume and the low transport weight, the loading of the empty bobbins and their transport is very easy.

In the procedure as provided for by this invention, the winding of the wire may be performed by rotating the bobbin around its longitudinal axis. This offers the advantage that the wire is put on without twist. However, it is also possible to use a stationary bobbin and to have the traversing unit as so-called flyer rotate around the bobbin.

In a preferred embodiment of the process as provided for by the invention, a winding type is wound onto the bobbin, as is prior art in EP-B-0 334 211. This means, the traversing unit is controlled by a control unit in such a way that the laying starts at the winding core with smaller diameter and that a first winding layer is laid, designed in such a way—with regard to the number and pitch of turns—that the winding covers only a smaller axial area of the winding core and does not extend to the end of the winding core with the larger diameter. The winding layer is then wound back and a new winding layer with an increased number of turns is laid. The succeeding winding layers are controlled in such a way that the winding layers in the field of the winding core with smaller diameter have the greatest distance from the rotation axis of the bobbin. This means, the winding layers, as seen in a central longitudinal section of the bobbin, are inclined towards the jacket of the winding core in an acute angle. This creates a double-conical winding design, resulting in an optimum strength of the package.

As described in the above mentioned EP-B-0 334 211, the laying of the winding may be done with the same number of turns or with a decreasing number of turns as soon as the first winding layer reaches the flange on the side of the winding core having a larger diameter, such that finally a winding design is created, in which the outer winding layers are parallel to the longitudinal axis of the bobbin.

The device as provided for by this invention for performing this process includes two bobbin holding members, holding the winding bobbin during the winding process. Each bobbin holding member includes a centering device to center the bobbin, as well as a holding device, for supporting at least the outer circumferential area of the relevant flange of the bobbin. Basically this holding device may be designed as supporting plate, supporting the flange surface. Instead of a surface support a point support is also possible, where a number of supporting surfaces of this supporting equipment are in contact with the flange of a winding bobbin to be received.

The winding device is preferably controlled by a control unit, to be able to generate a certain winding type.

In a preferred embodiment of the process according to the invention, a flyer device is connected to a drive unit. This flyer device connected to the drive unit revolves around the winding bobbin for winding up the winding material onto the winding bobbin. Preferably, winding up the winding bobbin is performed as follows: Firstly, a first winding layer with a predetermined winding number and a predetermined winding pitch is wound up starting at the end of the winding core having the smaller diameter. Afterwards, a second winding layer is wound up in a reverse axial direction. This second winding layer has the same winding number and the same winding pitch as the first winding layer has. After having wound up this second winding layer further winding layers are wound up the number of windings of which winding layers increases and the number of windings of each of which winding layers is such that a winding type will be formed on the bobbin, in which at least part of the winding layers are inclined towards the winding core as seen in the longitudinal section of the bobbin. This winding process with increasing winding number is continued until an end winding number is reached. This end winding number is the winding number which is allocated to the first winding layer which extends to the second winding core end having the larger diameter.

Furthermore the invention provides a winding bobbin, especially suited for the use with the process as provided for by this invention.

The winding bobbin as provided for by this invention is made of plastic and has a conical winding core, whose wall thickness is constant in general, such that the coning angle of the outer and inner jacket of the winding core is basically identical. At least the flange of the winding bobbin, arranged at the winding core with the smaller diameter, is detachably connected to it.

Due to this design it is possible to insert the winding cores separated from the detachable flange into each other. Thus the empty winding bobbin may be transported by separating the winding core and flange and stacking the winding cores and bobbin flanges in a space-saving way.

As will be shown later, this permits a considerable reduction in loading volume of the winding bobbins.

Plastics such as polyurethane, polypropylene, polystyrene, acrylonitrile-butadiene-styrene (ABS) may be used as bobbin material. In case a higher strength is required, the plastic may be reinforced by suitable materials, such as glass fibres.

The connection between bobbin core and the detachable flange should preferably have positive fit, i.e. preferably by snap-in elements, arranged at the winding core and at the bobbin flange, being engaged during assembly.

In a preferred embodiment of the winding bobbin, the second flange at the end with the larger winding core diameter cannot be detached. The second flange and the winding core are preferably designed as one piece and they may be manufactured together, e.g. by injection moulding.

To facilitate the stacking of full bobbins, juts and recesses have preferably been provided on the outer sides of both flanges, i.e. on the side opposing the winding core, engaging with each other when stacking the full bobbins. This again simplifies the transport of full bobbins.

It is pointed out that the use of these bobbins in connection with the process as proposed by this invention is of special advantage; however, the bobbins may also be used with other winding procedures and other winding devices.

BRIEF DESCRIPTION OF THE DRAWINGS

Further advantages, features and applications of the present invention result from the subsequent description of embodiment examples, illustrated by the relevant drawing.

DESCRIPTION OF THE PREFERRED EMBODIMENTS

An embodiment example of the winding device according to the present invention will be described subsequently with regard to FIG. 1.

Figure 8:
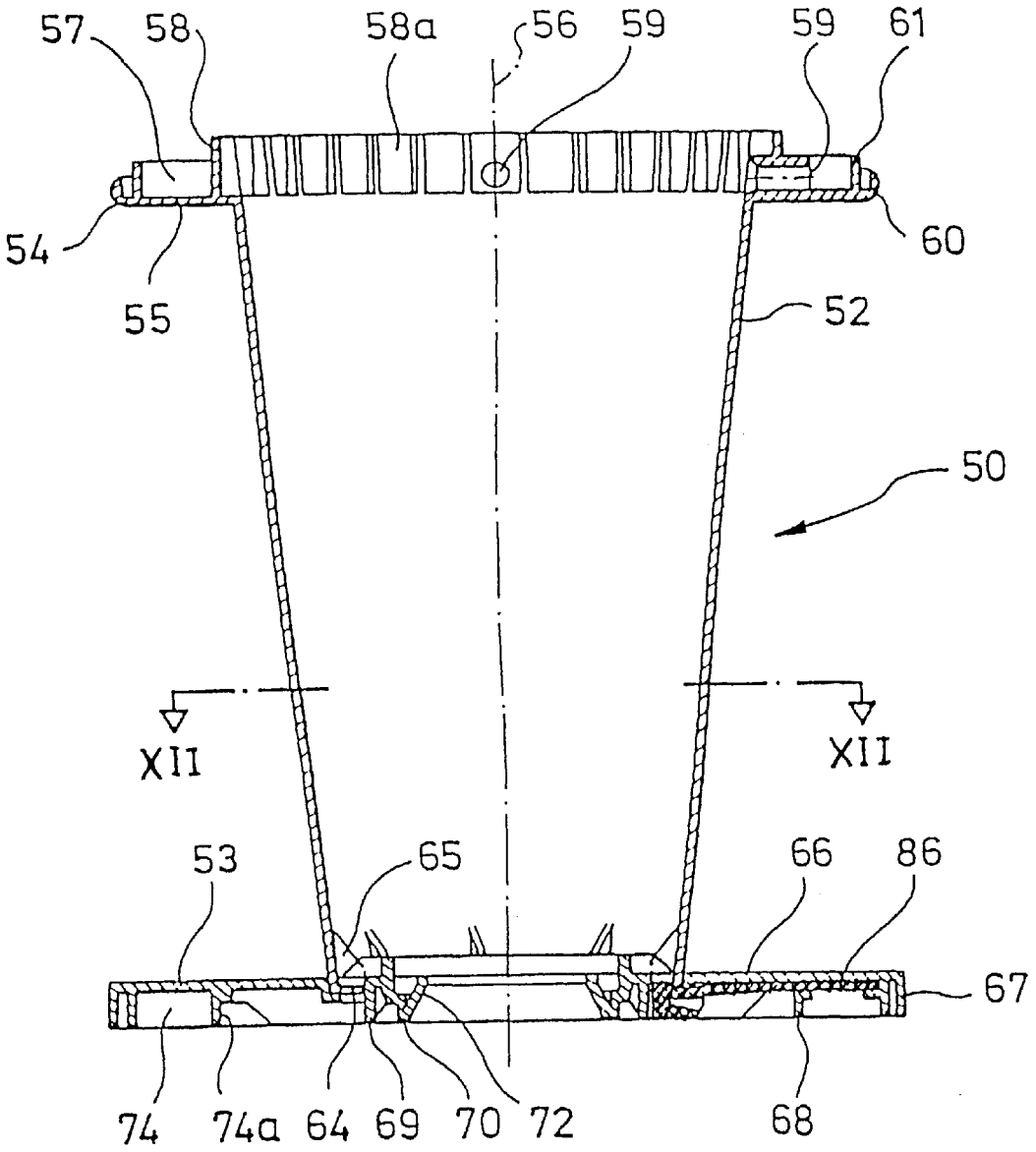
FIG. 8 shows a sectional view of a second embodiment example of a winding bobbin as provided for by this invention, along the line VIII—VIII in FIG. 10.

The device, in general referred to with 100, includes a first bobbin holding member 103 and a second bobbin holding member 104. The winding bobbin 50, still to be detailed with reference to FIG. 8, includes a conical winding core 52 and a first flange 53, as well as a second flange 54. The first flange 53 is arranged at the end of the winding core having a smaller diameter, the second flange 54 at the end of the winding core having a larger diameter. The winding bobbin is basically rotationally symmetrical to the axis 56 in longitudinal direction.

As shown, the winding device is to be designed preferably such, that the bobbin's longitudinal axis 56 is vertical and the first flange 53 is on the bottom and the second flange is on top.

The bobbin holding member 103 is also basically rotationally symmetrical and rotatable around axis 106. The bobbin holding member includes a ground plate 108, where a supporting plate 109 with smaller diameter is arranged. On the supporting plate 109 there is a cone 111, engaging with an accordingly formed bore 72 of flange 53 of the winding bobbin 50. This cone centers the winding bobbin with regard to the bobbin holding member 103.

Concentrical to bobbin holding member 103 a belt pulley 115 is arranged, driven by driving equipment 116 (not detailed) via driving belt 117.

The upper bobbin holding member 104 includes a plate 120, fixed on a plunger 122. The plate may be rotated around rotation axis 123, coinciding with axis 56 of the winding bobbin and axis 106 of the lower bobbin holding member. As shown by arrow 125, the plunger may be lifted and lowered by piston cylinder units 127 and 128 (not detailed). The pistons 129, 130 of the piston cylinder units are connected to plunger 122 by yoke 131.

On plate 120 a ring 112 is fixed, showing in the direction of the winding bobbin, its outer wall is inclined towards plate 120, the angle corresponding to the coning angle of the winding bobbin 50. A second ring 113 is joined on to the outer circumference of plate 120, also pointing to the bottom, to the winding bobbin.

In addition the winding device includes a traversing unit 140, provided with a laying roller 142, leading the wire and/or the cable D to the winding bobbin. As shown by double arrow 143, the laying roller 142 may be lifted and lowered in the direction parallel to the winding bobbin axis 56. In addition the traversing unit includes a threaded spindle 144, extending parallel to the longitudinal axis of the winding bobbin, rotatable in both directions via drive unit 145. Depending on the direction of rotation of the traversing unit, the laying roller will be lifted, i.e. moved in the direction of the drive unit 145, and lowered again.

The function of the winding device is controlled by a control unit (not shown). The control unit receives sensor signals, indicating the angular speed of the bobbin and signals indicating the relevant position of the laying roller 142.

On the basis of these signals drive unit 116 and drive unit 145 will be controlled such that the desired winding type will be formed on bobbin 50 during the winding process.

In the following paragraphs the function of this device will be described:

The plunger 122 and thus the bobbin holding member 104 will be lifted by a lifting movement of the piston cylinder units 127 and 128. A winding bobbin will either manually or by an automatic device be put onto the bobbin holding member 103, thus cone 111 of the bobbin holding member will engage into opening 72 of the winding bobbin, thus centering it.

Subsequently plunger 122 with the bobbin holding member 104 will be lowered, until it meets the upper bobbin end. The conical ring 112 thus centers the upper end of the winding core having the larger diameter and ring 113 of the bobbin holding member supports flange 54 of the bobbin.

Figure 4:
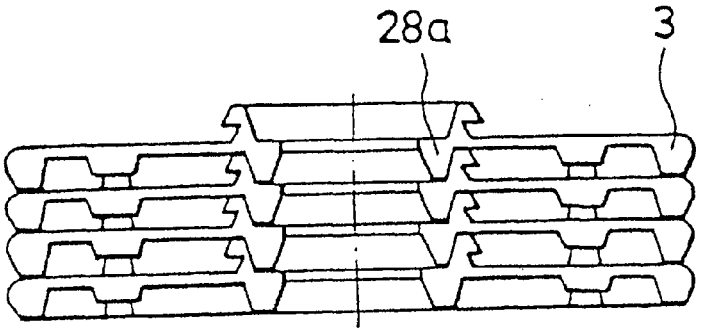
FIG. 4 shows several detachable flanges of the embodiment example according to FIG. 2 in stacked condition.

The wire end is then fixed on the lower flange 53, e.g. by an automatic device and the winding bobbin is then rotated to wind up the wire or cable. Drive unit 116 and 145 are preferably controlled in such a way that a winding type is formed, comparable to that in EP-B-0 334 211, in particular as shown in FIGS. 1, 2 and 4 and in the relevant description.

During the winding process the lower flange 53 is supported by supporting plate 109 and the upper flange 54 by plate 120 of bobbin holding member 104 and/or by ring 113.

In this way the flanges cannot deform due to the winding pressure or the weight of the winding material. This permits not only the absorption of the axial forces, but also of the radial forces, acting in the winding bobbin. In the lower bobbin holding member 103 this is done by cone 111, supporting large surfaces of the lower flange 53. As the flange may be equipped with suitable reinforcing ribs, as can be taken from the description, this support is able to prevent an unacceptable deformation of the flange, despite its low weight.

The upper end of the winding core and flange 54 will be held as if by tongs by ring 112 and ring 113, supported by an adequate jut of flange 54. Plate 120 directly absorbs the radial forces acting to the inside and to the outside, thus reliably preventing a deformation of the winding core and flange in this field.

As soon as the bobbin is full or the winding bobbin is removed from the winding device, respectively, the winding material or the wire, respectively, is caught and cut, preferably by an automatic catching and cutting device, and the end at the bobbin is fixed on the bobbin, preferably by an automatic device. This end of the winding material or the wire, respectively, is preferably fixed to the winding bobbin by fixing said end to the windings of said winding bobbin. Subsequently the bobbin will be taken out and it may be stacked or transported without any further packaging.

A first embodiment example of the winding bobbin, as it may be used in the device as provided for by this invention, is described with regard to FIGS. 2 to 7.

The bobbin 1 as shown in FIG. 2 consists of a conical winding core 2, a first flange 3 and a second flange 4. The first flange 3 may be detached and arranged at the end 2*a* of the winding core, having a smaller diameter.

The second flange 4 is arranged at end 2*b* of the winding core having a larger diameter, forming one piece with the winding core.

Basically the bobbin is rotationally symmetrical to axis 6 in its longitudinal direction.

At the end 2*a* of winding core 2 with the smaller diameter, a number of indentations 8 is provided in the winding core, having always the same distance to one another. By these indentations a variety of bars 9 is formed, which may be pressed to the outside against an elastic restoring force, i.e. away from the rotational axis 6.

Each bar 9 includes in its edge area, forming the end edge of the winding core with the smaller diameter, a snap-in pin 10 (see also FIG. 7), being basically vertical to the rotational axis 6 of the winding core.

On the second flange end, the fixed flange 4, reinforcing ribs 14 are provided, increasing the flange strength. In addition several bores 16 are arranged in the flange, being vertical to the rotational axis 6. The bores may be used for hoisting equipment, but also for fixing winding-off auxiliary equipment (see also FIG. 6).

As can be seen in FIG. 2, the coning angle 18 of the cylinder outer jacket 2*c* corresponds to the coning angle 19 of the cylinder inner jacket 2*d* or, in other words, the jacket of the winding core has a constant wall thickness between the two flanges.

As the end with the larger diameter 2*b* of the winding core is open, a conical hollow space 2*e* is formed, permitting the stacking of the winding core.

Figure 7:
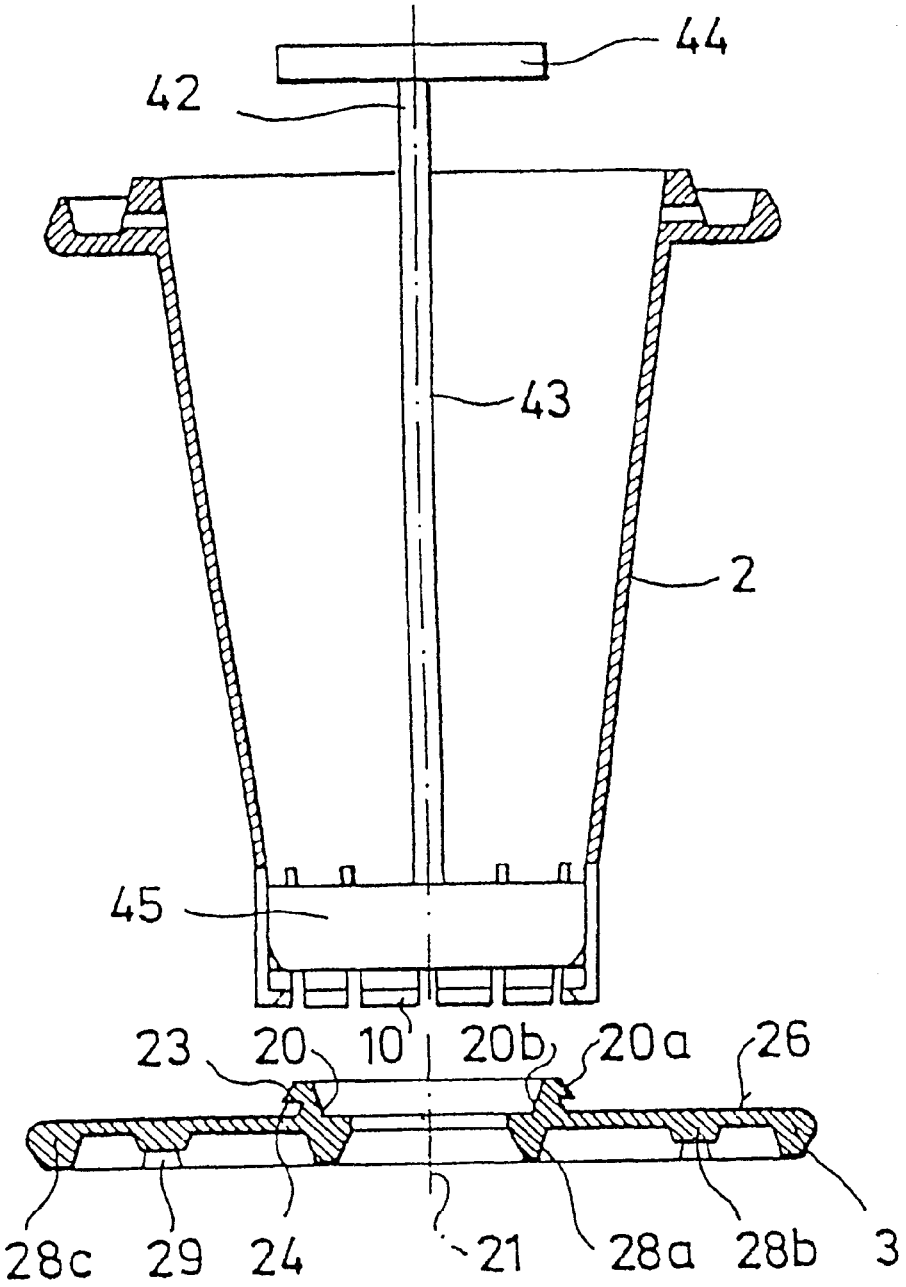
FIG. 7 shows an auxiliary equipment for disassembling the detachable flange in the embodiment example according to FIG. 2.

As may be seen in FIGS. 2 and 7, the first, detachable flange 3 includes a conical shoulder 20, rotationally symmetrical to axis 21, in assembled condition coinciding with rotational axis 6 of the winding core.

The conical shoulder 20 includes snap-in juts 23, whose snap-in surfaces are basically vertical to the cylinder axis 21; for assembly this conical shoulder 20 is directed towards winding core 2. The conical shoulder 20 is formed in one piece with the rotationally symmetrical flange plate 26. On the side opposing the winding core 2 there are three concentric ribs, forming an inner rib ring 28*a*, a middle rib ring 28*b* and an outer rib ring 28*c*.

In the middle rib ring 28 the indentations 29 are provided.

The function of this bobbin is as follows:

Winding core 2 and flange 3 will be manufactured separately, preferably by injection moulding with a suitable plastic material.

For bobbin assembly flange 3 will be put on a level surface and end 2*a* of the winding core will be pressed onto the conical shoulder 20. As the upper surface 20*a* of the conical shoulder is slightly conical, the bars 9 with the snap-in pins 10 are pressed to the outside, if pressure is exterted to the winding core in vertical direction to flange 3. As soon as the winding core 2 has been pushed far enough to the bottom, bars 9 with snap-in pins 10 spring back elastically and the snap-in pins 10 sit close to the snap-in surfaces 24. The assembly is finished and the winding may be started.

As soon as the first wire windings have been laid around the bobbin core (see FIG. 6), the snap-in pins 10 and the bars 9 will be hindered to move to the outside. Thus a firm positive connection between winding core 2 and the detachable flange 3 is achieved. As a consequence the strength of the connection is far higher than it corresponds to the elastic holding forces of bars 9. This means that the thickness of the winding core jacket and the geometrical arrangement of the snap-in pins may be chosen such that a manual assembly and disassembly is possible.

Additional securing means, such as a screw locking or the like, are not required.

Figure 3:
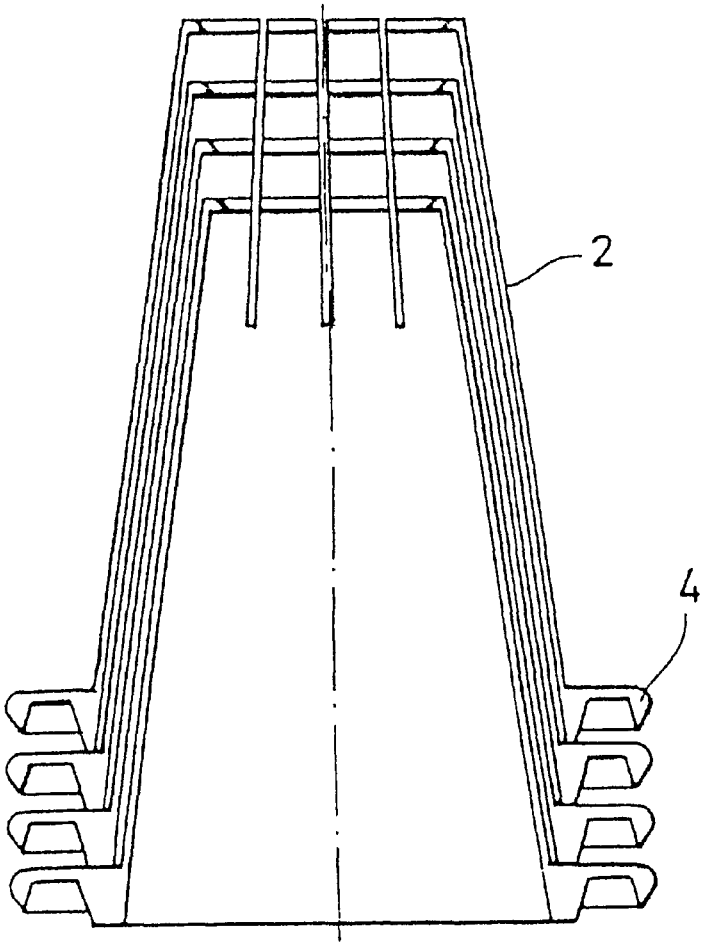
FIG. 3 shows several winding cores of the embodiment example according to FIG. 2 in stacked condition.

FIGS. 3 and 4 show the transport advantages of the winding bobbin as provided for by this invention. For transport winding core 2 and detachable flange 3 will be separated and the winding cores will be positioned in such a way that end 2*b* of the winding core having the larger diameter points to the bottom, e.g. on to a transport pallet. Then a large number of adequate winding cores may be stacked on the winding core, the winding cores always touching each other with the upper end of flange 4. Thus a small air gap is formed between the winding cores stacked into each other, minimizing the adhesional forces between the stacked winding cores, permitting an easy separation of the winding cores.

FIG. 4 shows how the detachable flanges 3 may be stacked.

As can be seen in FIG. 4, the inner rib ring 28*a* is designed such that it fits exactly into the conical opening 20*b* of the conical shoulder 20 of the flange. Thus the flanges may not only be stacked in a space-saving way, but a slipping of the flanges with regard to each other is prevented.

The following example shall explain the transport advantages of the bobbin design as provided for by this invention: In order to transport about 100 not decomposable bobbins of normal dimensions with a diameter of 400 mm, 17 pallets are required, as only 6 bobbins can be placed on one pallet. The overall loading area required amounts to 16,32 $m^2$, corresponding to a loading volume of 9,95 $m^3$ at a loading height of 610 mm.

If, however, 100 disassembled bobbins as provided for by this invention, are transported, four stacks with 25 winding cores and two stacks with 50 detachable flanges each may be arranged on one pallet. As a consequence the overall loading area corresponds to the area of a pallet of 0,96 $m^2$, corresponding to a loading volume of 1,224 $m^3$ at a loading height of 1275 mm.

The use of the bobbins as provided for by this invention results in a reduction of the loading area to 1/17 and a reduction of the loading volume to 1/8. In addition the loading and unloading is essentially simplified, as only one singular pallet has to be moved for loading these 100 bobbins.

However the design as provided for by this invention is also of advantage if full bobbins have to be transported.

Figure 5:
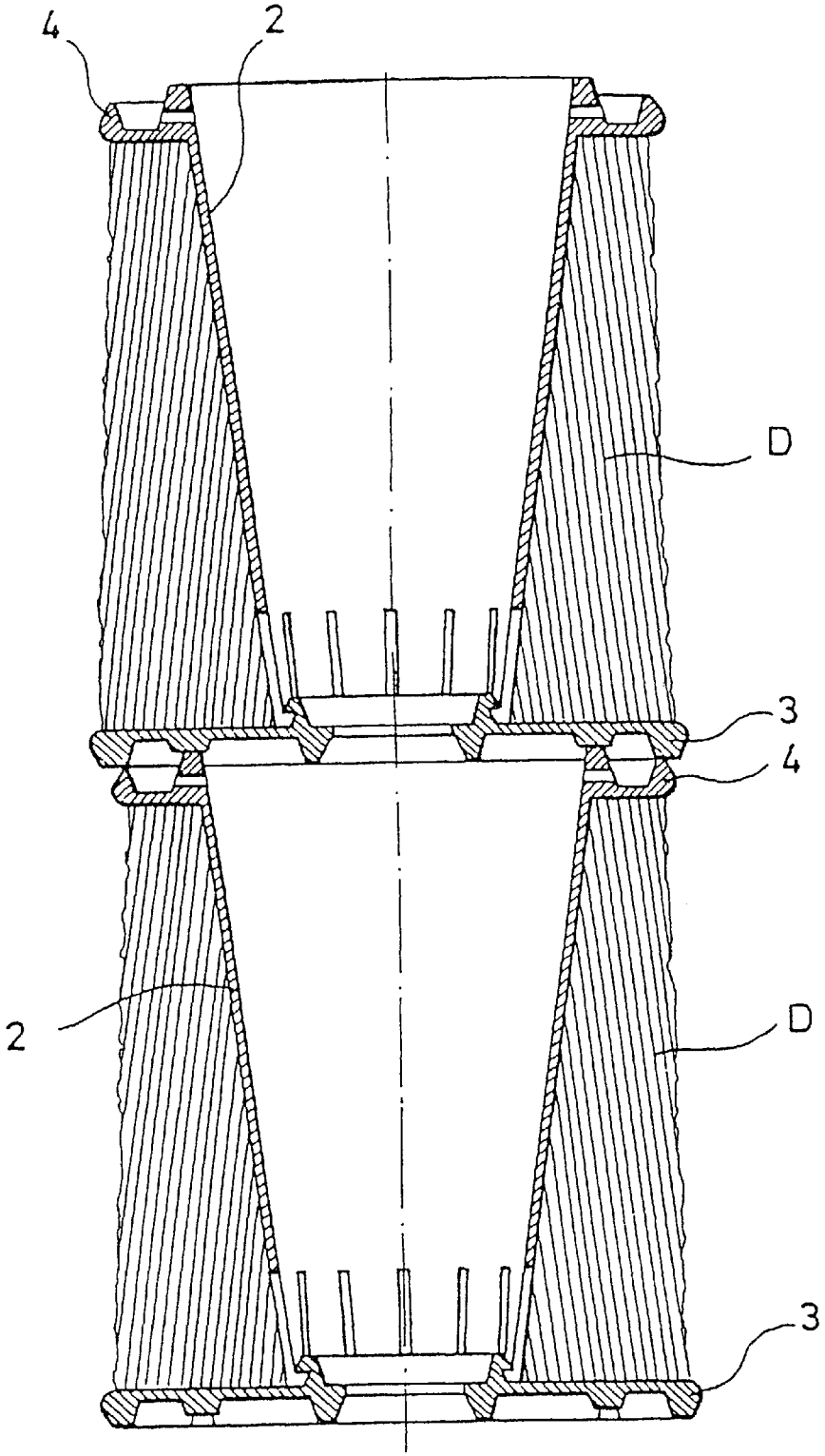
FIG. 5 shows several full bobbins of the embodiment example according to FIG. 2 in stacked condition.

As shown in FIG. 5, full bobbins may be stacked directly one upon the other. In this case the outer reinforcing ring 28*c* and the middle reinforcing ring 28*b* of the first detachable flange 3 are directly supported by the second fixed flange of the bobbin. In this case flange 4 engages into the indentations 29 in such a way that the winding bobbins are centered with respect to each other and furthermore a slipping of the bobbins with respect to one another is not possible. Due to the design as provided for by this invention, only half-full bobbins may be transported and stored too.

Figure 6:
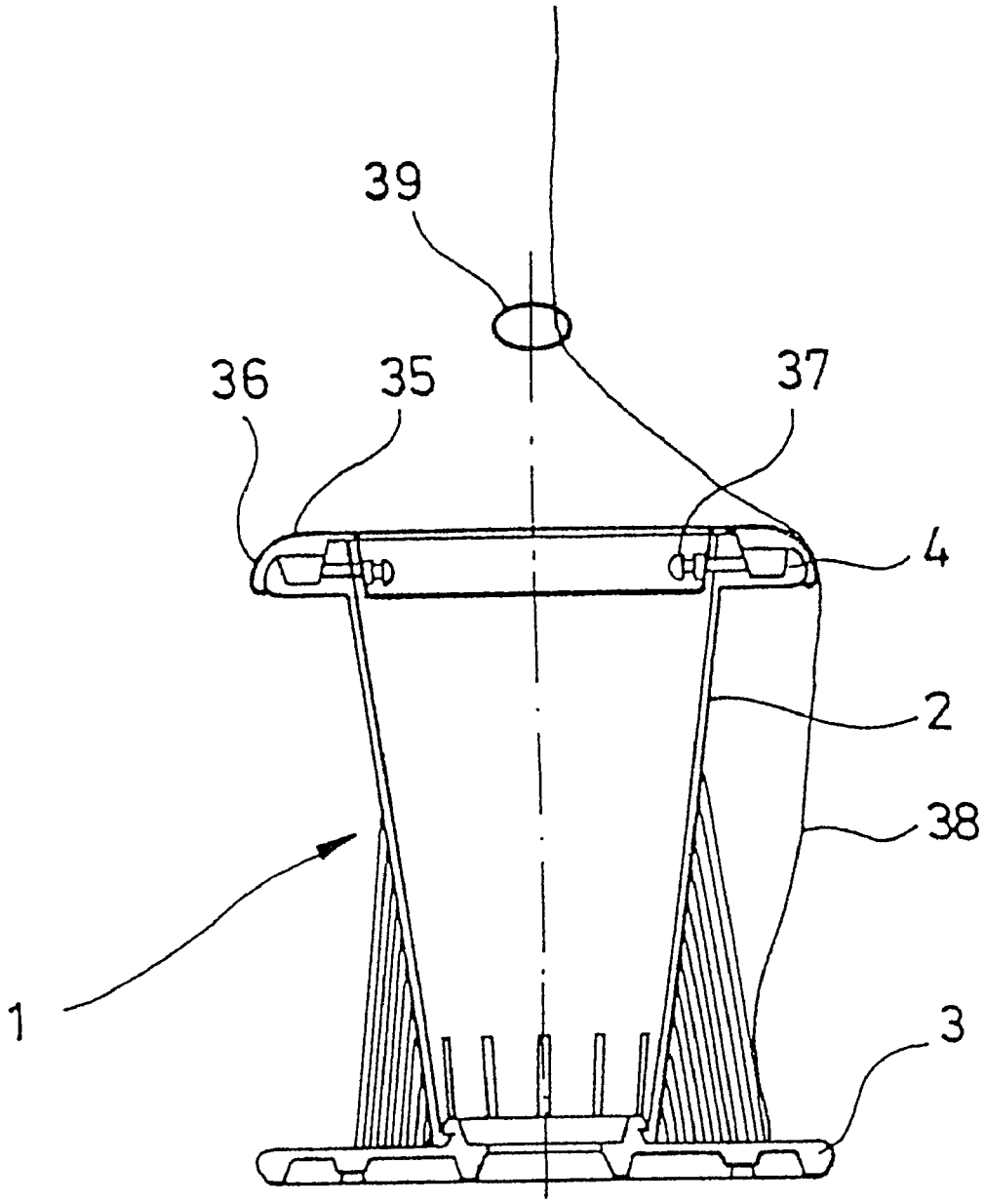
FIG. 6 shows the full winding bobbin according to FIG. 2 with a pulling-off device.

FIG. 6 shows how the bobbin may be used directly as winding-off device.

To this end the bobbin is placed vertically, as preferred in most cases during winding-on and winding-off, such that the detachable flange 3 is situated on level ground. A metal winding-off ring 35, having a vaulted metallic surface 36, is put on to the upper flange 4 or put on and/or inserted partly into the conical hollow space of winding core 2 and secured with bolt 37 in the bores 16.

As may be seen in FIG. 6, wire 38, wound on bobbin 1, is led over this winding-off ring 35 and through an eye 39. In this way the wire may be pulled off the bobbin without further auxiliary equipment.

It is also possible to pull off the wire directly from the bobbin without additional equipment, i.e. without winding-off ring.

FIG. 7 shows how winding core 2 and detachable flange 3 may be separated from each other.

To this end a plunger 42 is used as auxiliary device, consisting of a longer cylindrical rod 43 with a handle 44, a cylinder 45 being fixed at its lower end. The outer diameter of this cylinder is slightly larger than the internal diameter of the winding core in end area 2*a*.

For separating the two bobbin parts the auxiliary device 42 is inserted. As soon as cylinder 45 reaches the lower end area 2*a*, the bars 9 with the snap-in pins 10 will be bent to the outside and separated from the snap-in surfaces 24. Then the winding core will be lifted off from flange 3 without any further measures.

On the one hand the bobbin design as provided for by this invention has a high strength, on the other hand it may be transported in a simple and cost-effective way. Only a few seconds are required for assembling and/or disassembling the bobbin.

Due to the bobbin's stability the windings are held so steadily on the bobbin, in particular in case of the double-conical winding type, that special measures, such as fastening or hooping of the package is not required.

A second embodiment example of the winding bobbin is now described with reference to FIGS. 8 to 16.

The winding bobbin referred to as 50 has a conical winding core 52 and a first flange 53, detachably connected to winding core 52, arranged at the winding core end having a smaller diameter. A second flange 54 is arranged at the winding core end with larger diameter and these form one part. The bobbin in general is basically rotationally symmetrical to the longitudinal axis 56.

The winding core 52 with flange 54 joined on and the detachable flange 53 are made of plastic.

Flange 54 consists of a basically annular wall part 55, extending on a level surface, being vertical to rotational axis 56 of the bobbin. Wall part 55 is reinforced by reinforcing ribs 57 arranged vertically to it.

In addition wall part 55 is connected to a cylindrical annulus 58, whose diameter is larger than the upper end diameter of the winding core. Ring 58 is designed as one piece and has a variety of reinforcing ribs 58*a*.

In addition the upper flange 54 is provided with a variety of bores 59, used for fixing hoisting tools or for fixing a winding-off ring.

At the outer circumference of the flange an upwardly directly bevelling 60 is provided, rounded in itself. It is thus possible to use the upper flange 54 without winding-off ring directly as winding-off device.

Adjacent to this bevelling 60 there is a second cylindrical ring 61, giving additional stiffness to flange 54 and connected with reinforcing ribs 57.

Figure 12:
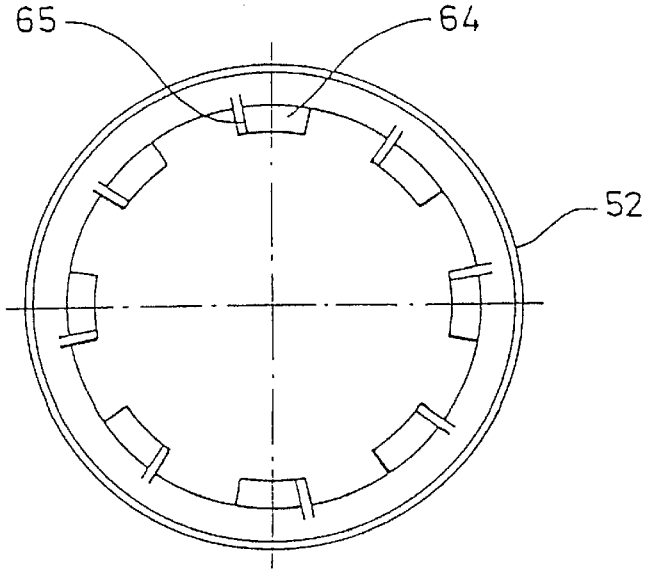
FIG. 12 shows a sectional view through the winding core along line XII—XII in FIG. 8, the lower flange being not shown.

As can be seen in FIG. 12, many snap-in juts 64 protruding to the inside are added to the winding core end having a smaller diameter, thus increasing the strength of the snap-in juts 64 by radial links 65 (see also FIG. 9) connected with the internal area of the winding core.

The snap-in juts 64—there are eight juts in the embodiment example—are arranged at equal distances around the internal circumference of the winding core and dimensioned in such a way that the distance in circumferential direction, i.e. the clear width between two adjacent snap-in juts, is slightly larger than the length of the snap-in juts itself.

In the embodiment example the juts for a typical dimension in a smallest winding core diameter of 178 mm are approximately dimensioned such that they extend 5 to 12 mm from the lower inner edge of the winding core to the inside.

In the assembled condition the first detachable flange 53 includes an annular plate 66 facing the winding material, having an outer annular reinforcement 67, opposing the winding material, designed in form of two concentric rings, a second middle reinforcement 68 in annular form as well as a third inner annular reinforcement 69. A centering ring 70 is provided concentric to the axis of rotation of the flange (corresponding to the axis of rotation of the bobbin in assembled condition), adjacent to the inner reinforcing ring 69, having a conical recess 72.

A large number of equidistantly arranged reinforcing ribs 74 is arranged on the flange side opposing the winding material for further flange reinforcement. In the outer flange area, between the outer reinforcing ring 67 and the middle reinforcing ring 68, the number of ribs is double as high as between the middle reinforcing ring 68 and the inner reinforcing ring 69, in order to effect a higher stiffness of the flange in this area.

Figure 14:
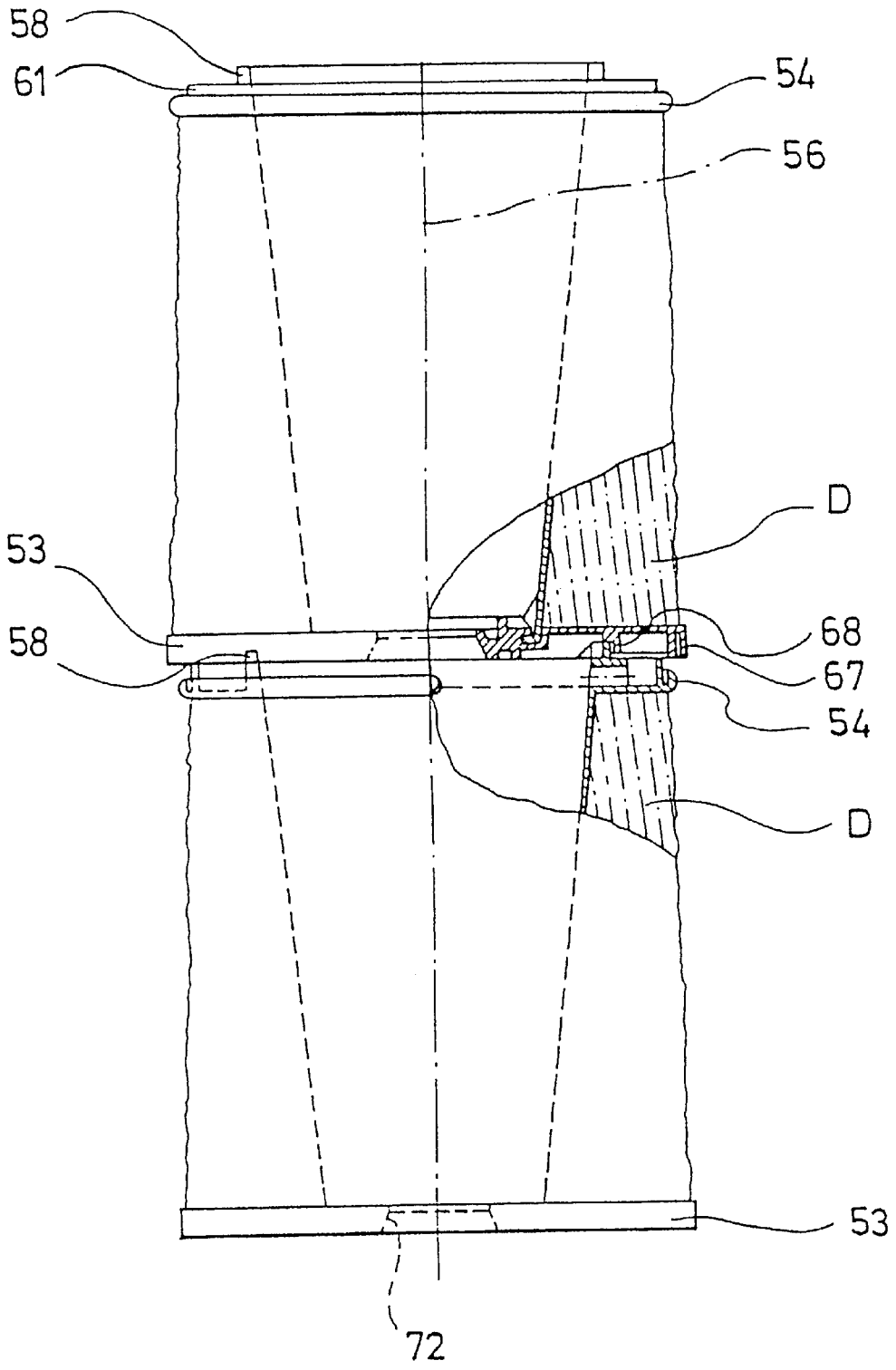
FIG. 14 shows a view, similar to that in FIG. 4, showing how full winding bobbins of the embodiment example according to FIG. 8 are stacked upon each other.
Figure 15:
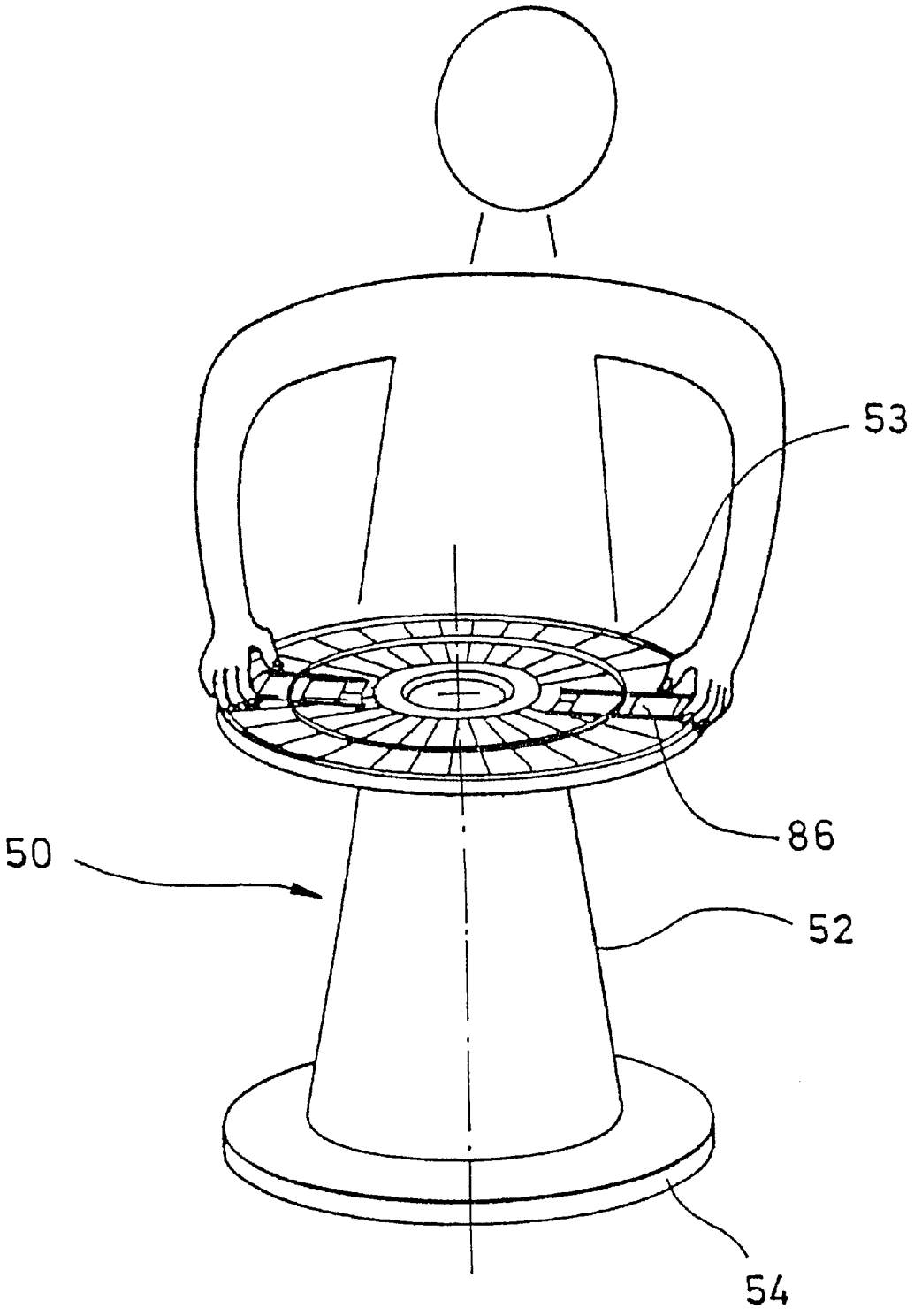
FIG. 15 shows the assembly of the detachable flange in case of a winding bobbin of the embodiment example according to FIG. 8.

The diameter of the reinforcing ring 68 is slightly larger than the diameter of the reinforcing ring 58 of the second flange 54. Furthermore the reinforcing ribs 74 in the reinforcing ring 68 have indentations 74*a* (see FIG. 8). In case the full bobbins are stacked one upon the other, as shown in FIG. 14, the reinforcing ring 58 of the second flange engages into the recesses 74*a*, the upper part of the reinforcing ring 58 resting on reinforcing ring 68. When stacked, the upper bobbin will thus be centered exactly with regard to the lower bobbin and slipping of the upper bobbin with regard to the lower bobbin is prevented.

On the side facing the winding material in assembled condition, flange 53 has an essentially annular recess 75, in which a holding structure 76 is arranged, acting together with the snap-in juts 64 of the winding core.

The holding structure 76 includes a cylindrical ring 78 arranged concentric to the axis of rotation, from where a number of holding juts 79 protrudes radially to the outside. On each holding jut a reinforcing rib 81 is arranged, extending in radial direction, forming an additional connection between the holding juts and the cylinder ring 78, thus stiffening the holding juts in axial direction of the winding bobbin.

As indicated by double arrow 83, a clearance in circumferential direction is provided between holding juts 79, being slightly larger than the dimension of the snap-in juts 64 of the winding core.

Figure 9:
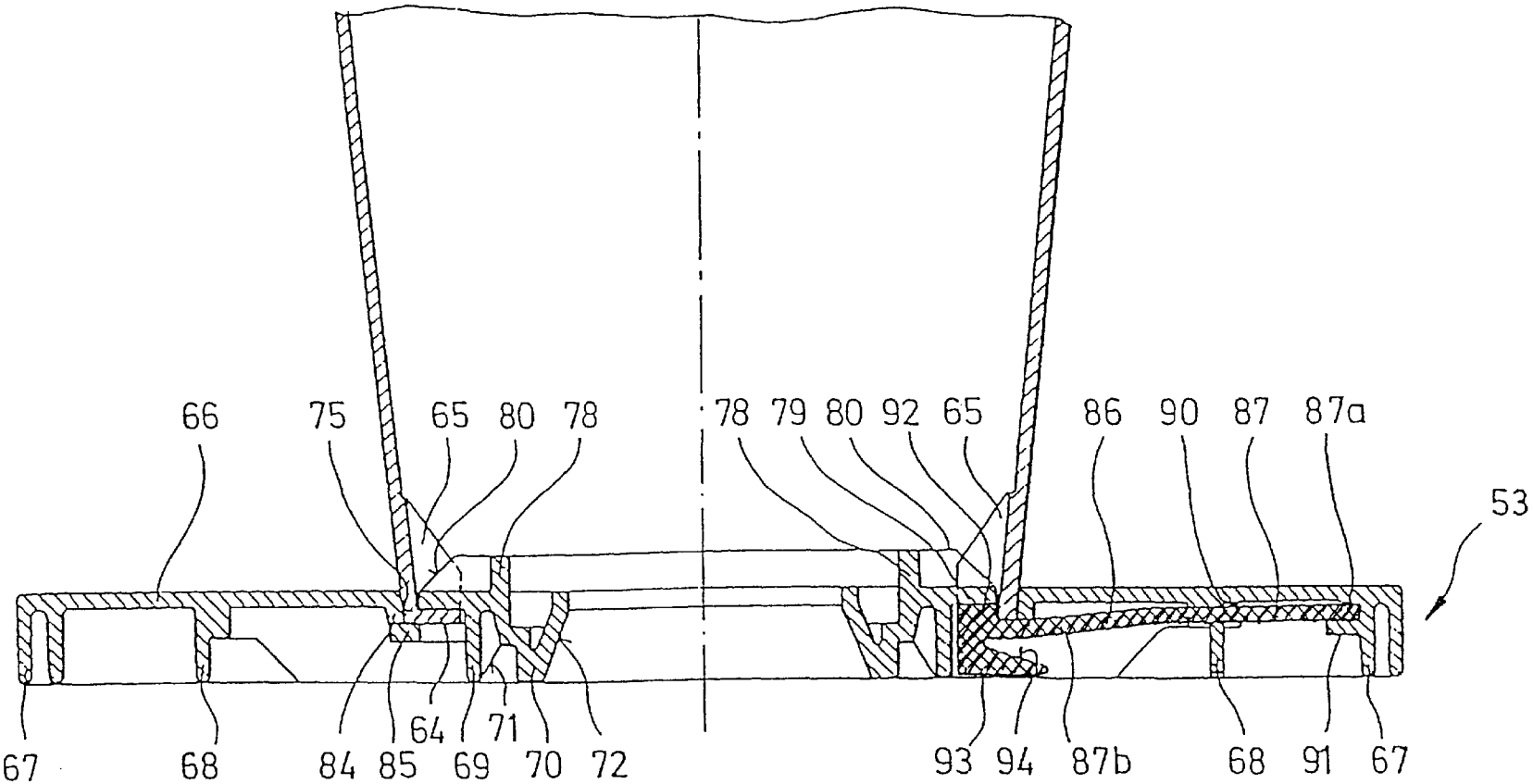
FIG. 9 shows an enlarged partial view of the winding bobbin according to FIG. 8.

As can be seen in FIG. 9, the annular recess 75 is formed by a first wall section 84, whose front wall surface, facing the winding core, is inclined towards the axis of rotation in the same angle as the wall of winding core 52. A second wall section 85 extends next to this first wall section 84, arranged vertical to the axis of rotation.

The connection between winding core and flange is formed by putting the winding core on the flange in such a way (see also FIG. 15) that the snap-in juts 64 are situated in the spacing 83 of the flange. In this way the winding core may be inserted into the flange such that the lower end of the winding core with the snap-in juts 64 touches the second wall section 85, as shown in FIG. 9. Subsequently the winding core and flange are twisted with respect to each other, until the links 65 of the snap-in juts 64 sit close to the links 81 of the holding juts 79. In this position always one snap-in jut 64 engages with an allocated holding jut 79, such that an axially secured connection between winding core and flange is formed.

Figure 10:
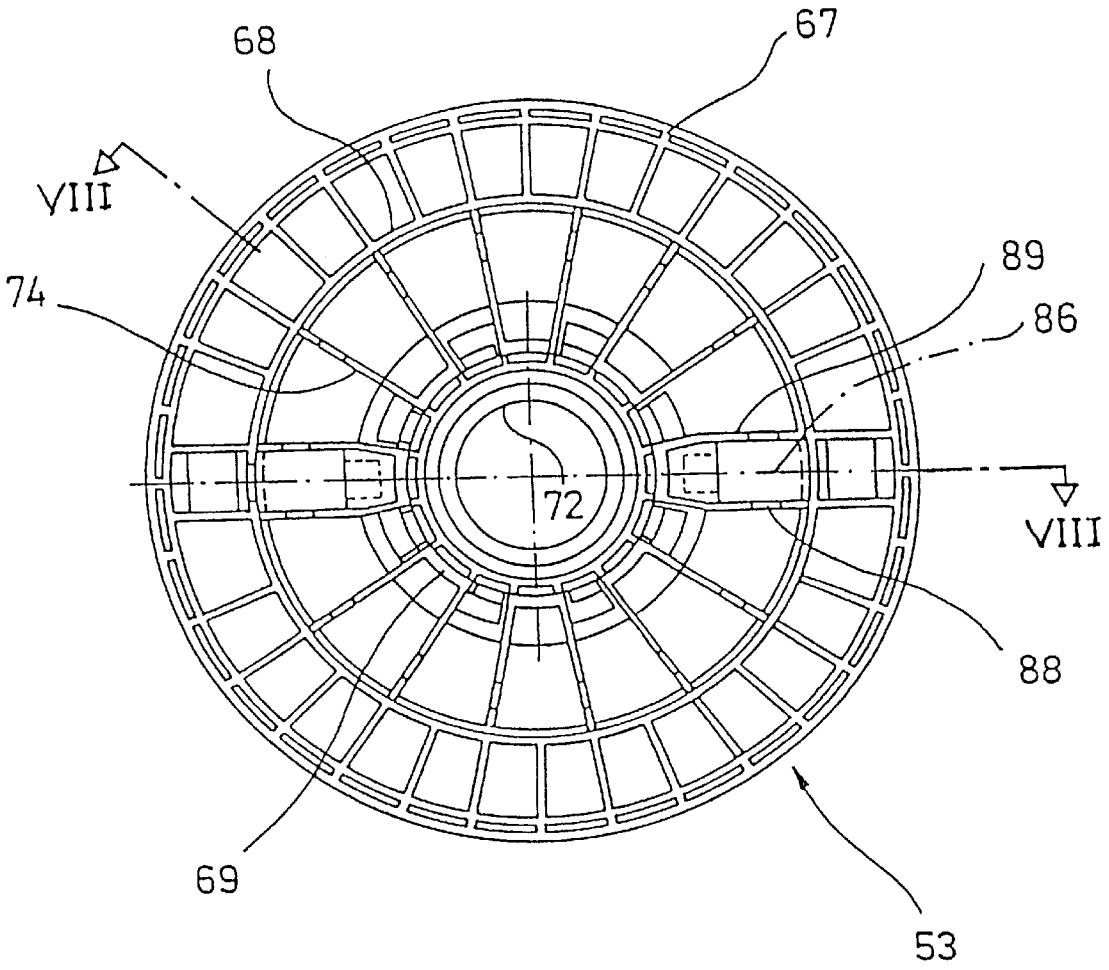
FIG. 10 shows a subview of the small flange of the winding bobbin according to FIG. 8, here subview means as seen from the side opposing the winding core of the flange.
Figure 11:
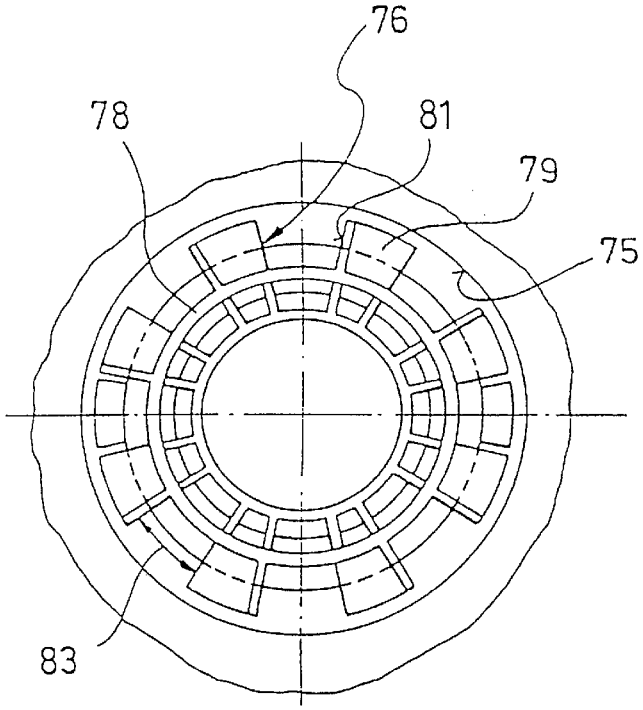
FIG. 11 shows a partial view of the smaller flange according to FIG. 10, as seen from the upper side, the winding core not being shown.

In order to secure the connection radially, at least one locking element is provided, its design is described with regard to FIGS. 9, 10 and 11.

The locking element 86 consists of an elastic material such as plastic or metal and includes a longitudinal plate 87, held by two lateral links 88 and 89 in the flange. In addition a recess 90 is provided in the middle reinforcing ring 68, holding plate 87, and the reinforcing ring 67 is provided with a rib 91, protruding radially to the inside, forming a bag, holding the end 87*a* of the plate of the locking element 86, opposing the winding core. In this position plate 87 is basically parallel to the surface of flange 53 facing the winding material and it is held in this position.

At the end 87*b* of the plate, facing the winding core, a bracket 92 is joined on, forming one piece with the plate; its width is slightly smaller than the width of an interspace 83 between the two holding juts 79 of the flange.

On the side of plate 87 opposing bracket 92, a wedge-shaped enlargement is joined on, forming a wedge gap 94.

The front end 87*b* of the plate has only a minor distance to the inner reinforcing ring 69 of flange 53, such that the locking element 86 is held captively at the flange by rib 91, recess 90 and rib 69.

The function of this locking element will be described below. When inserting the winding core into the annular recess 75 of the flange, the locking element (as shown in FIG. 9) will be elastically deformed and pressed down. As soon as the lower end of the winding core reaches the second wall section 85, the winding core will be turned, the snap-in juts 64 thus being positioned below juts 79. In this position the interspace between the two adjacent holding juts, where the locking element is arranged, gets free and the locking element again moves up due to the elastic restoring force. Thus the interspace between these holding juts will be closed and a relative motion of the winding core and the flange in radial direction towards each other is prevented. Thus the flange is secured in this condition axially as well as radially with regard to the winding core.

The wedge-shaped indentation 93 has a double function.

Figure 1:
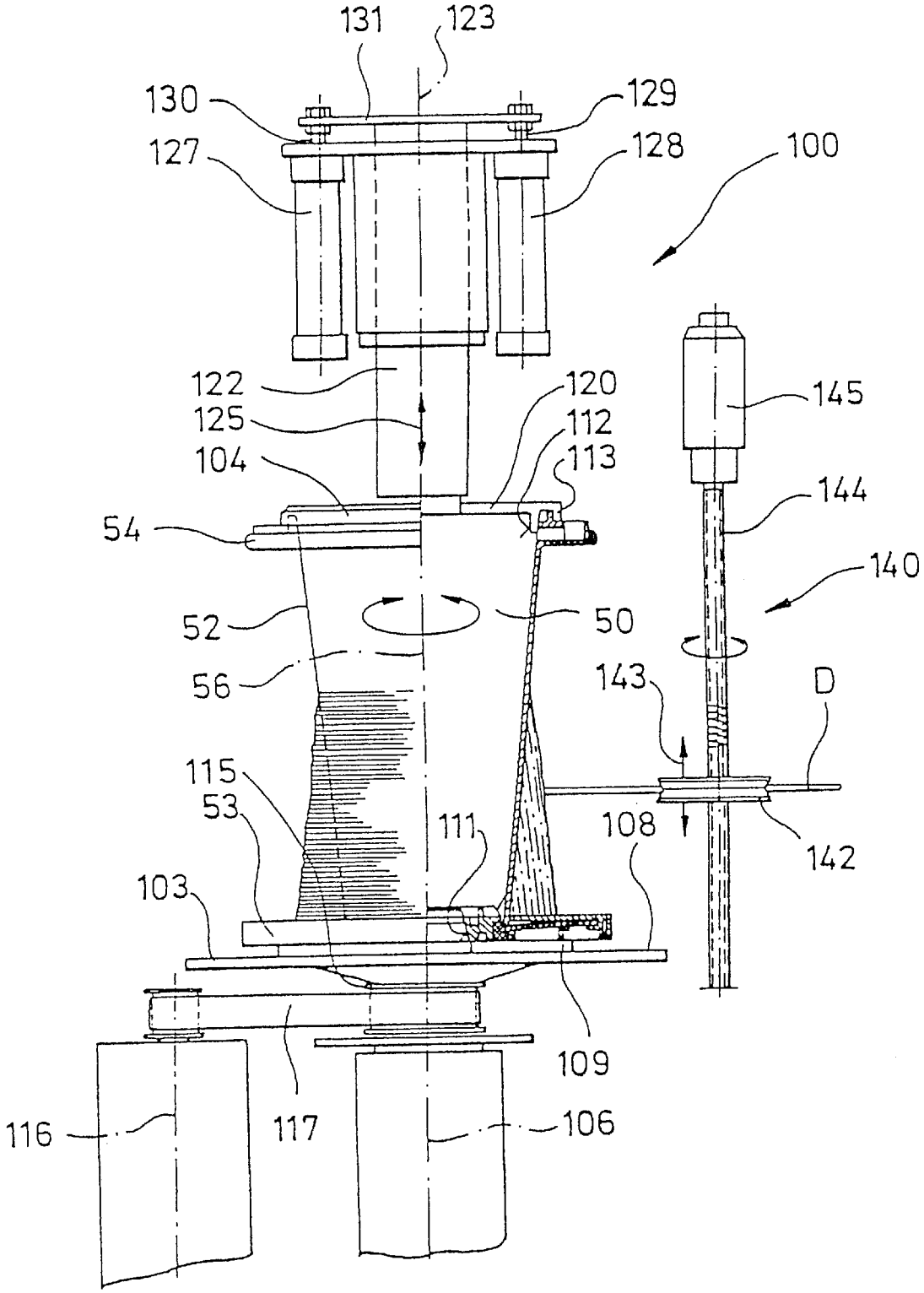
FIG. 1 shows a side view of an embodiment example of the winding device as provided for by this invention, half of the winding bobbin used is shown as longitudinal section.
Figure 1A:
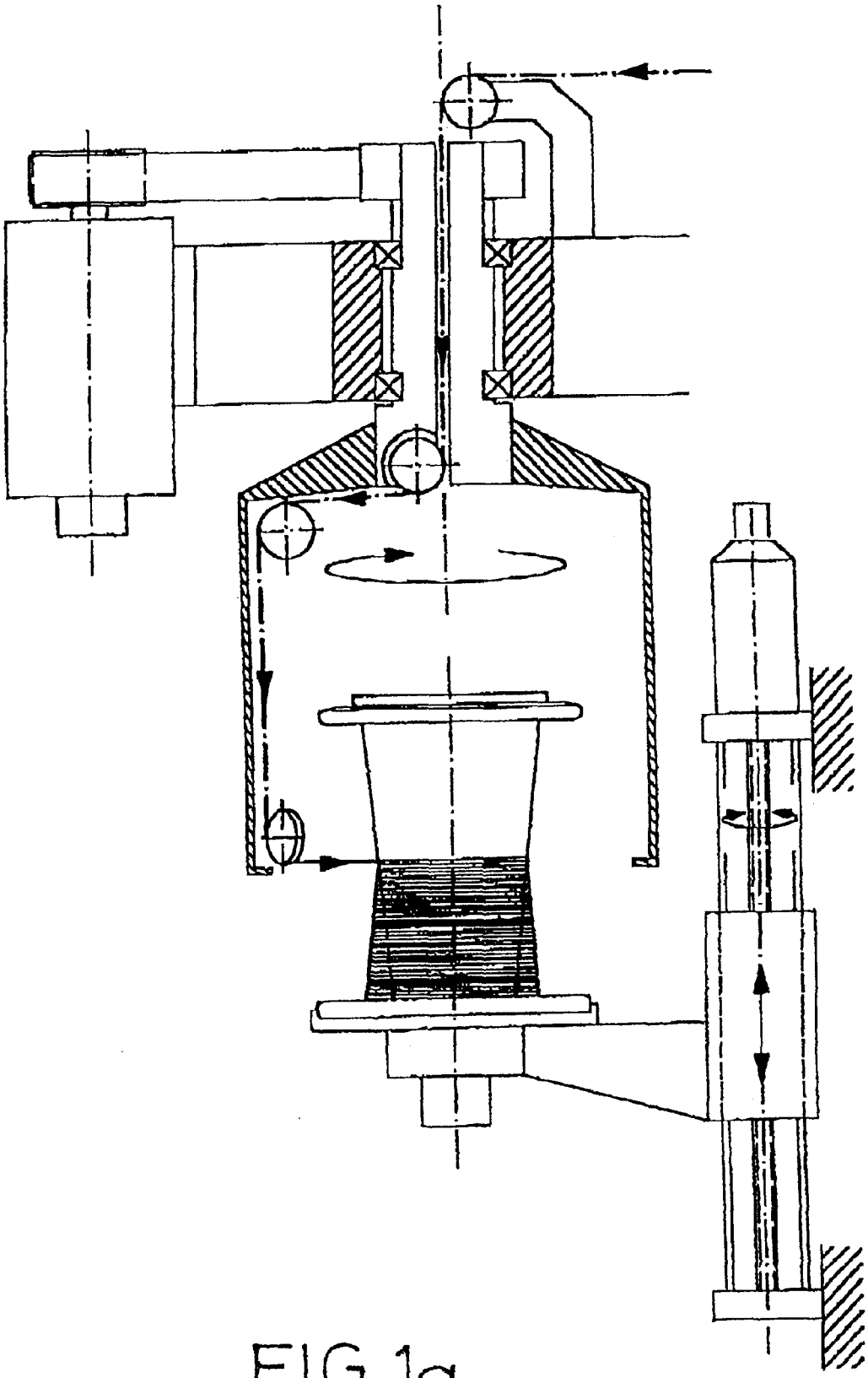
FIG. 1*a* shows a view, largely corresponding to that of FIG. 1, showing the apparatus of the invention with a traversing unit, connected to a drive and moving around the stationary bobbin.
Figure 2:
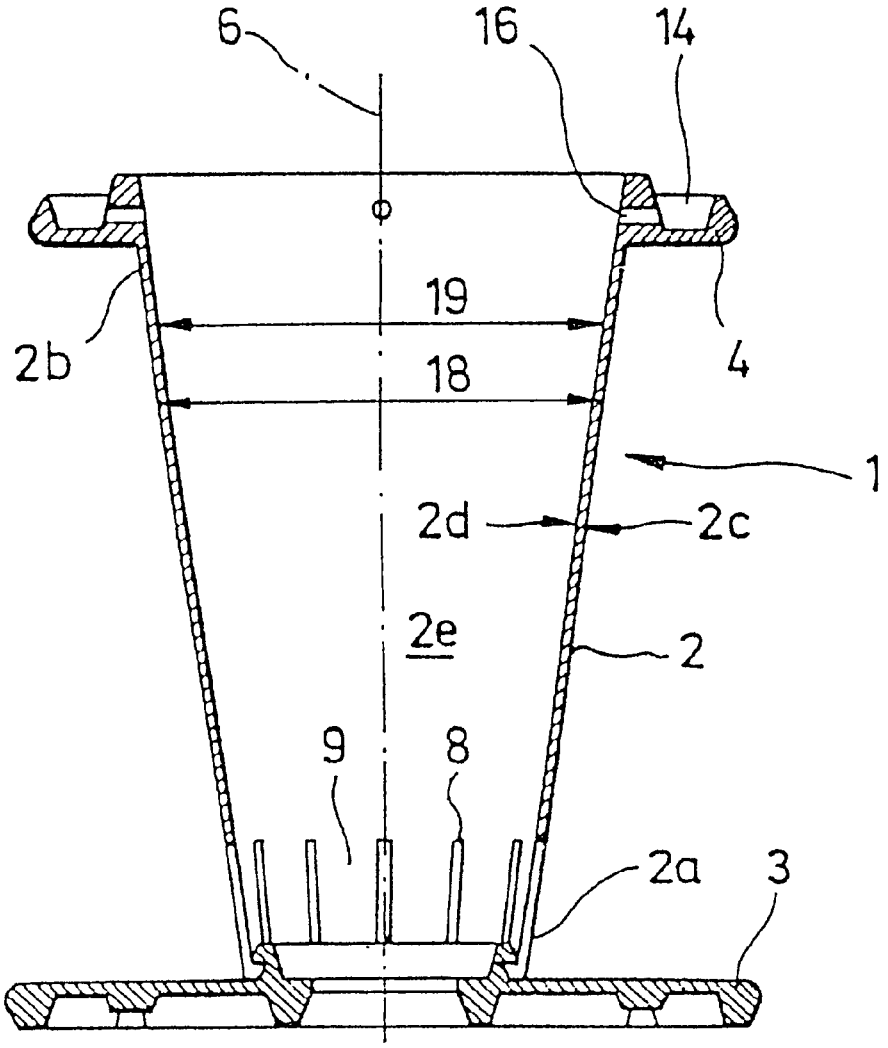
FIG. 2 shows a longitudinal section through a first embodiment example of a winding bobbin, as provided for by this invention in the asssembled state.

As can be seen in FIG. 1, the lower flange 53 of the winding bobbin 50 will be supported by supporting plate 109 when received in the winding device. As the lower end of the wedge-shaped enlargement (see FIG. 9) is exactly identical to the lower ends of the reinforcing ribs 67, 68 and 69, this wedge-shaped enlargement will also be supported by supporting plate 109. Thus a movement of the locking element in axial direction towards the winding core is prevented, such that a deformation of the locking element and thus a release of the radial locking is excluded.

Figure 16:
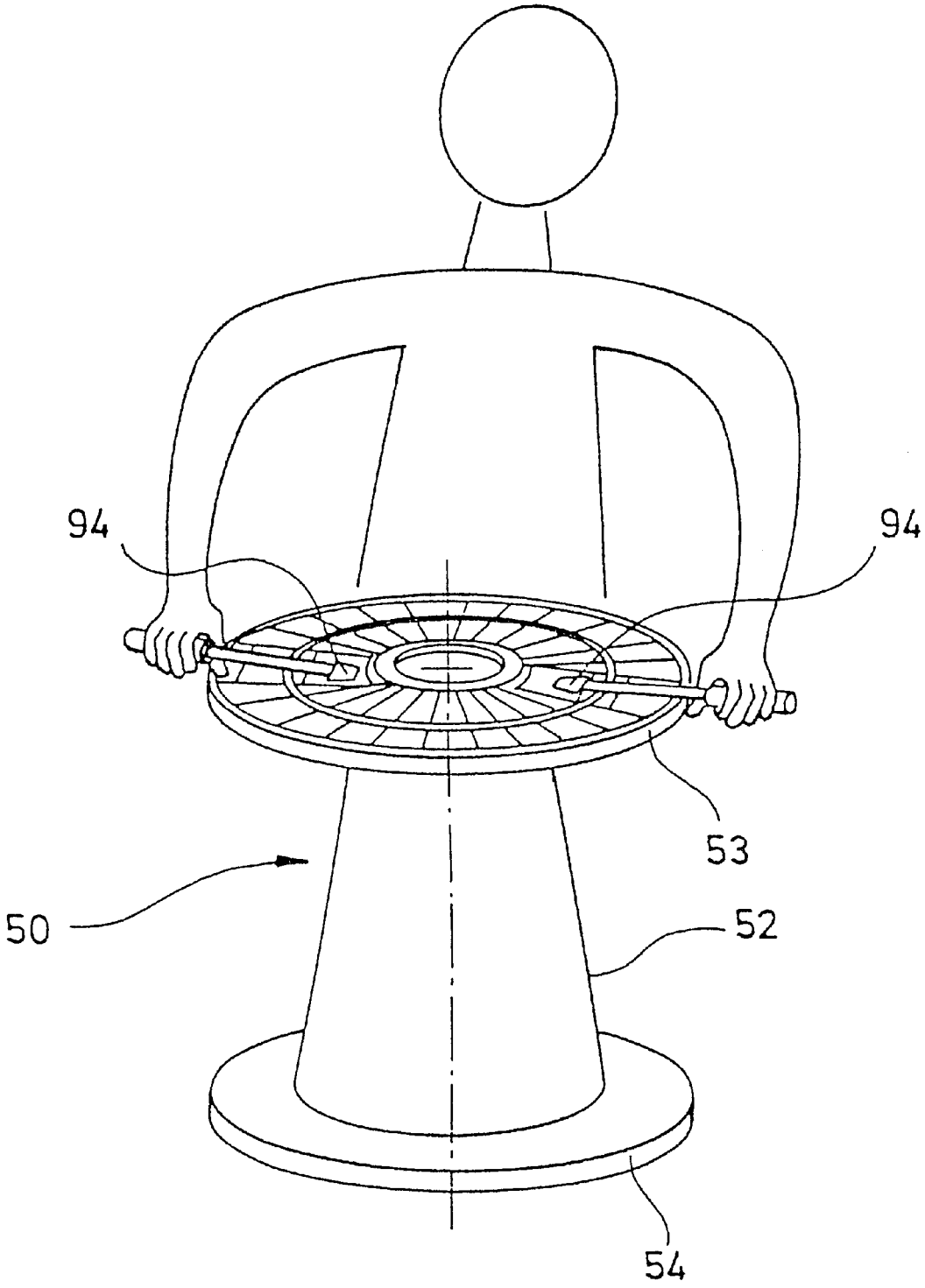
FIG. 16 shows the disassembly of the detachable flange in case of a winding bobbin of the embodiment example according to FIG. 8.

As shown in FIG. 16, a suitable tool, e.g. a screw driver, may be inserted into the wedge-shaped gap 94 for disassembling the winding core. The wedge-shaped gap 94 and thus the front end 87*b* of plate 87 will thus be pressed down (as can be seen in FIG. 9), the link 92 thus clearing the interspace between the adjacent holding juts; flange and winding core may be twisted with respect to one another. The winding core may then be taken off from the flange without any further manual activity.

After separating the detachable flange 53 from winding core 52, the winding cores may be stacked in a similar space-saving way, as shown in FIG. 3.

Figure 13:
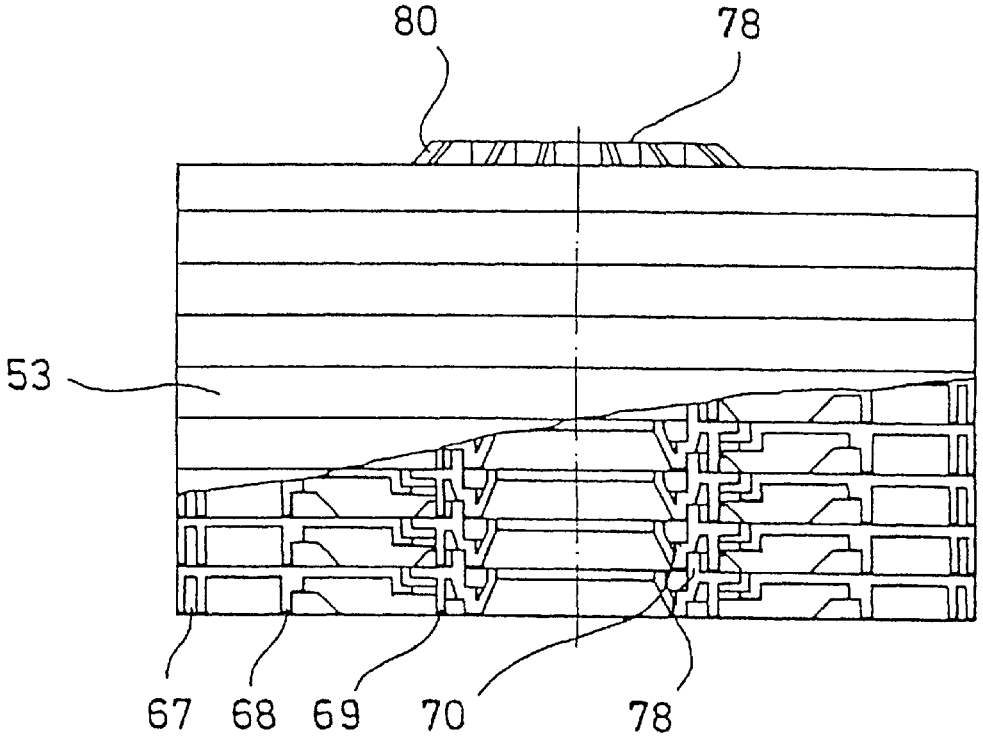
FIG. 13 shows a view, similar to that in FIG. 3, with a number of detachable flanges of the winding bobbin according to FIG. 8, in stacked condition.

As depicted in FIG. 13, even the detachable flanges 53 of bobbin 50 may be correspondingly stacked one upon the other in a space-saving way (see FIG. 4).

When stacking the flanges upon each other (see FIG. 9 and FIG. 13), ring 78 engages in interspace 71 between ring 69 and ring 70 of flange 53. To this end ring 69 has a number of notches, indicated in FIGS. 9 and 10, into which the links 81 engage when stacked.

By the interaction of ring 78, ring 69 and ring 70, the flanges will be secured radially to each other, such that they cannot move with respect to each other in stacked condition. In addition, the fixed links 81 and the allocated notches result in a twist locking of the flanges in stacked condition.

As can be seen, the present invention proposes a process and a device, able to create a package, consisting of a winding bobbin with wire or cable wound on it, offering special transport and processing advantages. As the package is of high strength, in particular when using a double-conical winding type, it may be transported without further packaging material. Therefore the user of this package has no waste to dispose of. Due to the comfortable stacking ability of the divisible plastic bobbin proposed in this invention, the plastic bobbin may be stored at the user in a space-saving way and also transported back to the wire or cable manufacturer in a space-saving way.

What is claimed is:

1. A process for manufacturing a package with elongated winding material which can be transported without packaging, said process using a winding bobbin comprising a conical winding core having a longitudinal axis, spaced radially extending snap-in-juts, and a first and a second flange, in which the second flange on the winding core side having a smaller diameter is detachably connected to the winding core with the second flange having second radially protruding holding juts with spacing therebetween; including the following procedure steps in chronological sequence:

composing said winding bobbin by assembling said detachable flange to said winding core, said assembling being performed by nserting the winding core into said detachable second flange in such a way that spaced radially extending snap-in-juts of the winding core are inserted into said spacing of said spaced radially protruding holding juts of said second flange;

twisting the winding core and the second flange with respect to each other so that each snap-in-jut engages one holding jut, thereby establishing an axial connection between the second flange and the winding core;

securing the connection between said detachable second flange and said winding core, by at least one locking element, said locking element being provided in said detachable second flange and being elastically deformed out of a first position when the snap-in-juts are inserted between the holding juts and moves back in its previous first position when said second flange and the winding core have been twisted, thereby establishing a radially secured connection such that the detachable flange cannot get loose from the winding core during winding and transport;

integrating the winding bobbin into a winding device;

receiving the winding bobbin in the winding device by means of two bobbin holding members, centering the two flanges and supporting them against the winding pressure on flange surfaces opposing the winding core, each of these surfaces being directed towards an adjacent bobbin holding member;

winding up the winding material on the winding bobbin, said winding being controlled by a control unit such that a predetermined winding type will be formed on the bobbin;

terminating the winding process and removing the winding bobbin from the winding device as soon as the bobbin is as full as desired.

2. A process according to claim 1, wherein the bobbin holding member, arranged at the side of the bobbin having the detachable flange, contacts said locking element in such a way that said locking element cannot be deformed in its opened position which opened position of the locking element enables that the detachable second flange can get loose from said winding core.

3. A process according to claim 2, further comprising the following procedure steps:

winding up a first winding layer starting at the end of the winding core having the smaller diameter, said first winding layer having a predetermined winding number and a predetermined winding pitch;

forming a second winding layer in a reverse axial direction with respect to said axis of said winding bobbin as that first layer, said second layer having the same winding number and the same winding pitch as that first layer;

applying further winding layers with an ever increasing number of windings;

the number of windings of each winding layer being chosen such that a winding type will be formed on the bobbin, in which at least part of the winding layers are inclined towards the winding core as seen in the longitudinal section of the bobbin;

continuation of these winding processes with increasing winding number until an end winding number is reached, at which the winding layer reaches the second winding core end with the larger diameter;

continuation of the winding process by applying further winding layers with a predetermined winding number.

4. A process according to claim 1, wherein the winding bobbin is rotatable supported and rotates during a winding process.

5. A process according to claim 4, further comprising connecting at least one bobbin holding member to a drive unit causing rotation of the bobbin holding member.

6. A process according to claim 5, further comprising the following procedure steps:

winding up a first winding layer starting at the end of the winding core having the smaller diameter, said first winding layer having a predetermined winding number and a predetermined winding pitch;

forming a second winding layer in a reverse axial direction with respect to said axis of said winding bobbin as that first layer, said second layer having the same winding number and the same winding pitch as that first layer;

applying further winding layers with an ever increasing number of windings;

the number of windings of each winding layer being chosen such that a winding type will be formed on the bobbin, in which at least part of the winding layers are inclined towards the winding core as seen in the longitudinal section of the bobbin;

continuation of these winding processes with increasing winding number until an end winding number is reached, at which the winding layer reaches the second winding core end with the larger diameter;

continuation of the winding process by applying further winding layers with a predetermined winding number.

7. A process according to claim 6, wherein after having reached the end winding number for the first time and during continuation of the winding process by applying further winding layers, the winding number decreases with regard to said end winding number.

8. A process according to claim 6, wherein said increase of winding numbers of winding layers which succeed is such that after applying a number of winding layers and prior to reaching said end winding number there are at least some of these individual winding layers having their maximum distance to the axis of rotation of the winding bobbin at the flange arranged at the end of said winding core with said smaller diameter.

9. A process according to claim 5, wherein during continuation of said winding process by applying further winding layers, the winding number is equal to said end winding number.

10. A process according to claim 4, further comprising the following procedure steps:

winding up a first winding layer starting at the end of the winding core having the smaller diameter, said first winding layer having a predetermined winding number and a predetermined winding pitch;

forming a second winding layer in a reverse axial direction with respect to said axis of said winding bobbin as that first layer, said second layer having the same winding number and the same winding pitch as that first layer;

applying further winding layers with an ever increasing number of windings;

the number of windings of each winding layer being chosen such that a winding type will be formed on the bobbin, in which at least part of the winding layers are inclined towards the winding core as seen in the longitudinal section of the bobbin;

continuation of these winding processes with increasing winding number until an end winding number is reached, at which the winding layer reaches the second winding core end with the larger diameter;

continuation of the winding process by applying further winding layers with a predetermined winding number.

11. A process according to claim 1, further comprising connecting a flyer device to a drive unit such that the flyer device revolves around the winding bobbin for winding up the winding material onto the winding bobbin.

12. A process according to claim 11, further comprising the following procedure steps:

winding up a first winding layer starting at the end of the winding core having the smaller diameter, said first winding layer having a predetermined winding number and a predetermined winding pitch;

forming a second winding layer in a reverse axial direction with respect to said axis of said winding bobbin as that first layer, said second layer having the same winding number and the same winding pitch as that first layer;

applying further winding layers with an ever increasing number of windings;

the number of windings of each winding layer being chosen such that a winding type will be formed on the bobbin, in which at least part of the winding layers are inclined towards the winding core as seen in the longitudinal section of the bobbin;

continuation of these winding processes with increasing winding number until an end winding number is reached, at which the winding layer reaches the second winding core end with the larger diameter;

continuation of the winding process by applying further winding layers with a predetermined winding number.

13. A process according to claim 1, further comprising the following procedure steps:

winding up a first winding layer starting at the end of the winding core having the smaller diameter, said first winding layer having a predetermined winding number and a predetermined winding pitch;

forming a second winding layer in a reverse axial direction with respect to said axis of said winding bobbin as that first layer, said second layer having the same winding number and the same winding pitch as that first layer;

applying further winding layers with an ever increasing number of windings;

the number of windings of each winding layer being chosen such that a winding type will be formed on the bobbin, in which at least part of the winding layers are inclined towards the winding core as seen in the longitudinal section of the bobbin;

continuation of these winding processes with increasing winding number until an end winding number is reached, at which the winding layer reaches the second winding core end with the larger diameter;

continuation of the winding process by applying further winding layers with a predetermined winding number.

14. A process according to claim 1, wherein the winding material is cut after the winding bobbin being as full as desired and wherein winding bobbins are used which enable that after removing the winding bobbin from the winding device and cutting the winding material, the bobbins are stacked directly one upon another such that the flange arranged at the end of a first winding core having a larger diameter, is supported by at least an outer reinforcing ring and a middle reinforcing ring, these reinforcing rings being formed concentrically with respect to each other on the surface of the detachable flange opposing a second winding core and the middle reinforcing ring showing indentations into which the flange of the first winding core engages such that the winding bobbins are centered and prevented from slipping with respect to one another.

15. A process according to claim 1, wherein, before removing the winding bobbin from the winding device the winding material is caught, cut and the respective end of the winding material is fixed to the windings of the winding bobbin.

16. A process according to claim 1, wherein the winding material is cut after the winding bobbin being as full as desired and wherein, after removing the winding bobbin from the winding device and after cutting the winding material, the following steps are performed in order to enable repetition of said process for manufacturing a package by using the same winding bobbin:

winding-off the winding material; and separating the second flange from the winding core such that a first end of an elastic plate of said locking element is elastically deformed and pressed out of its locking position;

twisting the winding core and the second flange with respect to each other in a direction until all snap-in-juts are fully situated between the spacings of the holding snaps in the detachable flange;

moving the winding core and the second flange away from each other.

* * * * *

UNITED STATES PATENT AND TRADEMARK OFFICE

CERTIFICATE OF CORRECTION

PATENT NO. : 6,062,506
DATED : May 16, 2000
INVENTOR(S) : Werner Eck and Hans-Georg Horndler It is certified that error appears in the above-identified patent and that said Letters Patent is hereby corrected as shown below:

Column 11,
Line 66 "When inserting ..." should begin a new paragraph starting on line 67.

Claim 1,
Line 14 delete "nserting" and insert therefore -- inserting --.

Claim 4,
Line 2 delete "rotatable" and insert therefore -- rotatably --.

Signed and Sealed this

Twenty-fourth Day of July, 2001

Nicholas P. Godici

*Attest:*

*Attesting Officer*

NICHOLAS P. GODICI
*Acting Director of the United States Patent and Trademark Office*